US009057364B2

(12) United States Patent
Gerritsen

(10) Patent No.: US 9,057,364 B2
(45) Date of Patent: Jun. 16, 2015

(54) BICYCLE AIR PUMP

(75) Inventor: Marcel Gerritsen, Nunspeet (NL)

(73) Assignee: Shimano Benelux B.V., Nunspeet (NL)

( * ) Notice: Subject to any disclaimer, the term of this patent is extended or adjusted under 35 U.S.C. 154(b) by 1210 days.

(21) Appl. No.: 12/182,172

(22) Filed: Jul. 30, 2008

(65) Prior Publication Data

US 2010/0028180 A1 Feb. 4, 2010

(51) Int. Cl.
*F04B 33/00* (2006.01)

(52) U.S. Cl.
CPC ..... *F04B 33/005* (2013.01)

(58) Field of Classification Search
CPC ..... F04B 33/005
USPC ..... 417/469, 481, 487; 92/15
See application file for complete search history.

(56) References Cited

U.S. PATENT DOCUMENTS

| | | | | |
|---|---|---|---|---|
| 2,976,075 | A * | 3/1961 | Budreck | 294/65.5 |
| 3,584,776 | A * | 6/1971 | Bolte | 227/130 |
| 3,740,041 | A * | 6/1973 | Jones | 261/64.1 |
| 6,289,920 | B1 | 9/2001 | Wang | |
| 6,325,601 | B2 | 12/2001 | Wu | |
| 6,328,057 | B1 | 12/2001 | Wang | |
| 7,353,746 | B2 * | 4/2008 | Kutella | 92/61 |
| 2007/0221056 | A1 * | 9/2007 | Kutella | 92/61 |

FOREIGN PATENT DOCUMENTS

| | | | |
|---|---|---|---|
| CH | 686 527 | A5 | 4/1996 |
| DE | 296 17 886 | U1 | 8/1997 |
| JP | 06-219360 | A | 8/1994 |
| WO | WO-2010/025511 | A1 | 3/2010 |

* cited by examiner

*Primary Examiner* — Bryan Lettman
(74) *Attorney, Agent, or Firm* — Global IP Counselors

(57) ABSTRACT

A bicycle air pump includes a cylinder portion, an inner piston, a piston rod, a head portion, a handle and a magnetic mechanism. The cylinder portion includes a first end, a second end and a chamber disposed between the first and second ends. The inner piston is movably disposed in the chamber of the cylinder portion. The piston rod has a first end and a second end coupled to the inner piston. The head portion is coupled to the cylinder portion. The head portion includes an outlet passage communicated with the chamber cylinder portion for supplying air to an object to be inflated. The handle is coupled to the piston rod to move within the chamber. The magnetic mechanism includes first and second closure members for engaging together magnetically to hold the piston rod stationary with respect to the cylinder portion.

12 Claims, 10 Drawing Sheets

BICYCLE AIR PUMP

BACKGROUND OF THE INVENTION

1. Field of the Invention

This invention generally relates to a bicycle air pump for inflating, e.g., bicycle tires. More specifically, the present invention relates to a bicycle air pump in which a closure mechanism is provided to hold the bicycle air pump in a closed position.

2. Background Information

Bicycling is becoming an increasingly more popular form of recreation as well as a means of transportation. Moreover, bicycling has become a very popular competitive sport for both amateurs and professionals. Whether the bicycle is used for recreation, transportation or competition, the bicycle industry is constantly improving the various components of the bicycle.

Many riders carry a bicycle air pump with them in case of a flat tire. Bicycle air pumps are often configured to be mounted to a bicycle frame member such as the down tube or the seat tube. In some cases, two spring clamps are used to both attach the bicycle air pump to the bicycle frame and to hold the bicycle air pump in a retracted position. When the bicycle air pump is detached from the bicycle frame, the bicycle air pump can inadvertently move to an extended position.

In view of the above, it will be apparent to those skilled in the art from this disclosure that there exists a need for an improved bicycle air pump in which the bicycle air pump is normally held in the retracted position even when detached from the bicycle frame. This invention addresses this need in the art as well as other needs, which will become apparent to those skilled in the art from this disclosure.

SUMMARY OF THE INVENTION

One object of the present invention is to provide a bicycle air pump with a magnetic mechanism that can hold the bicycle air pump in a fully retracted position.

In accordance with one aspect, a bicycle air pump that basically comprises a cylinder portion, an inner piston, a piston rod, a head portion, a handle and a magnetic mechanism. The cylinder portion includes a first end, a second end and a chamber disposed between the first and second ends. The inner piston is movably disposed in the chamber of the cylinder portion. The piston rod has a first end and a second end coupled to the inner piston. The head portion is coupled to the cylinder portion. The head portion includes an outlet passage communicated with the chamber cylinder portion for supplying air to an object to be inflated. The handle is coupled to the piston rod to move within the chamber. The magnetic mechanism includes first and second closure members for engaging together magnetically to hold the piston rod stationary with respect to the cylinder portion.

The above object and other objects, features, aspects and advantages of the present invention will become apparent to those skilled in the art from the following detailed description, which, taken in conjunction with the annexed drawings, discloses preferred embodiments.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
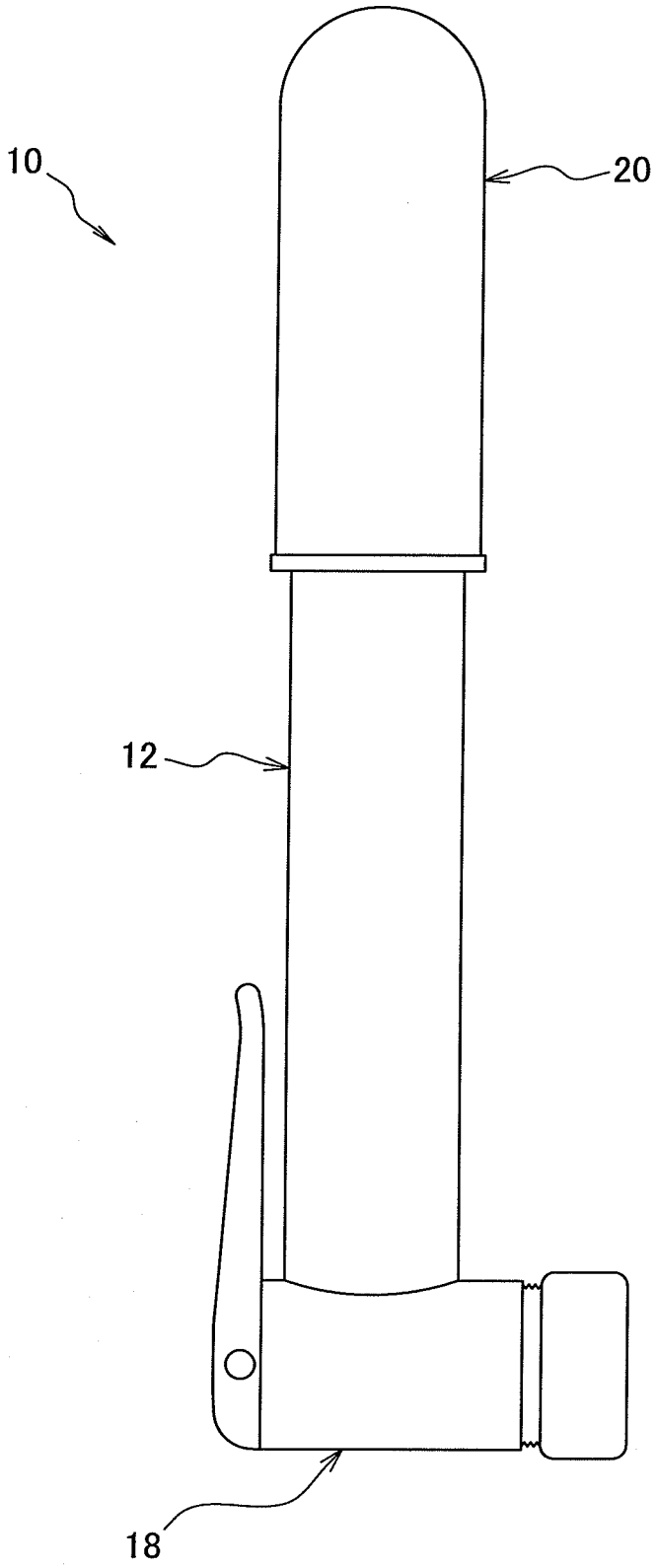
FIG. 1 is a side elevational view of a bicycle air pump in accordance with a first embodiment.
Figure 2:
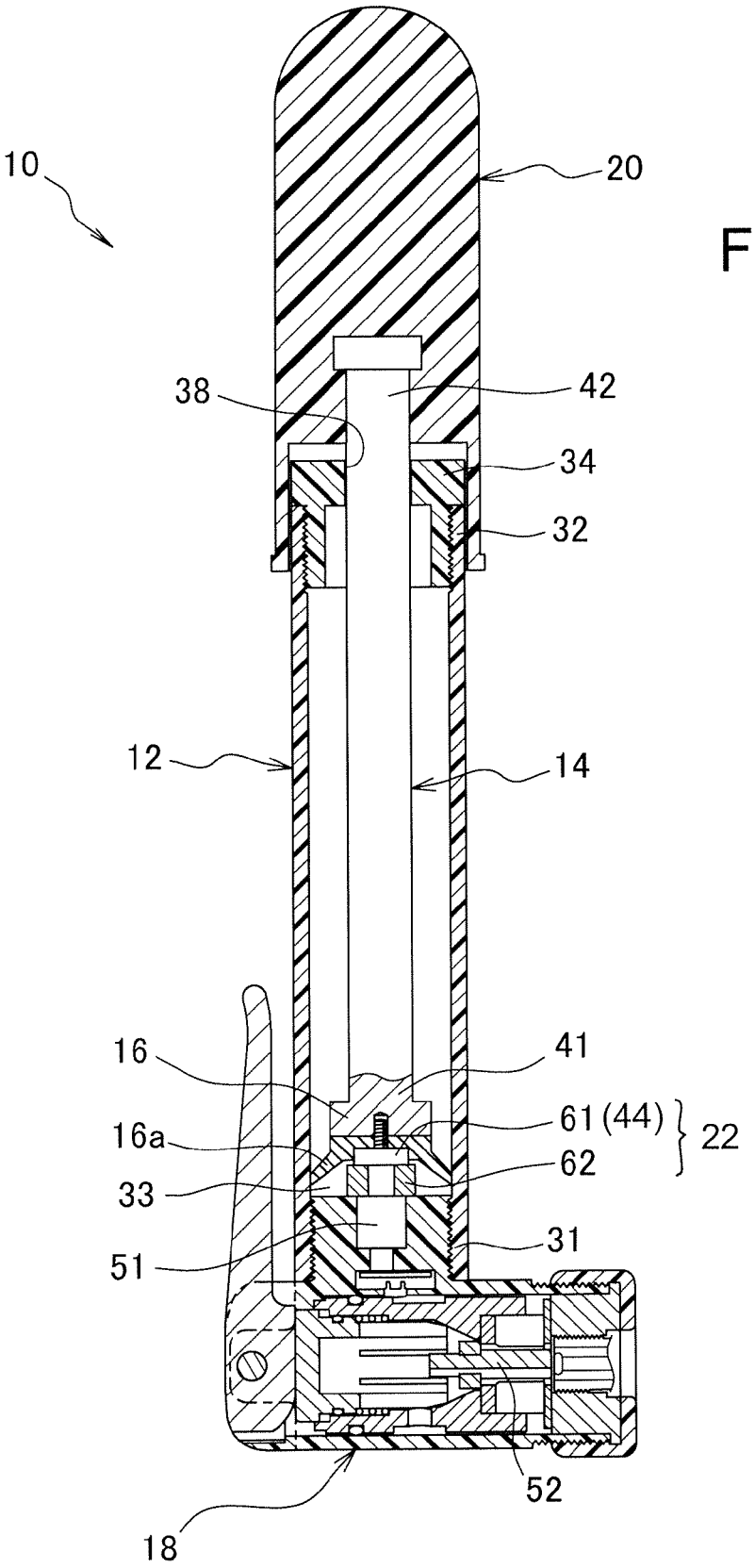
FIG. 2 is a longitudinal cross sectional view of the bicycle air pump illustrated in FIG. 1 in which the handle of the bicycle air pump is magnetically held in a retracted position.
Figure 3:
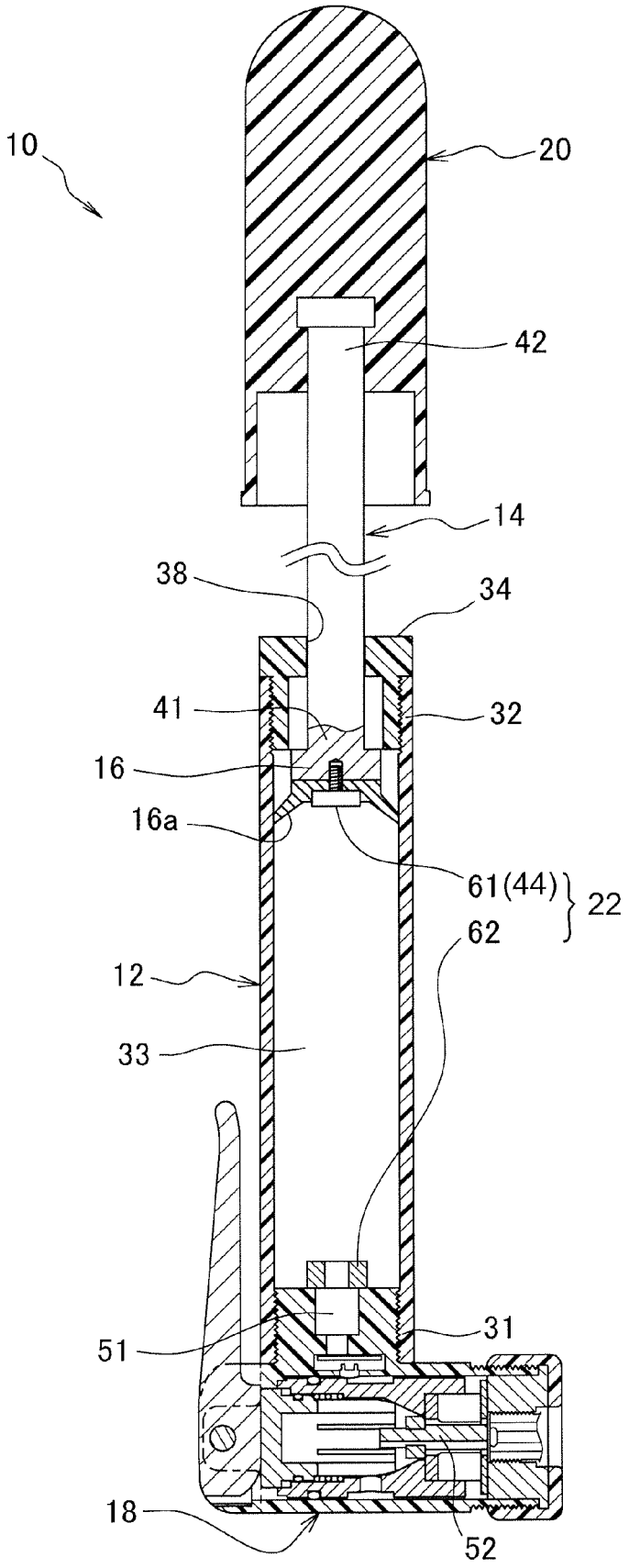
FIG. 3 is a longitudinal cross sectional view of the bicycle air pump illustrated in FIGS. 1 and 2 in which the handle of the bicycle air pump is in an extended position.

Referring initially to FIGS. 1 to 3, a bicycle air pump 10 is illustrated in accordance with a first embodiment. The bicycle air pump 10 basically includes a cylinder portion 12, a piston rod 14 with an inner piston 16, a head portion 18, a handle 20 and a magnetic mechanism 22. Basically, the bicycle air pump 10 is a conventional bicycle air pump, except for the addition of the magnetic mechanism 22 as discussed below. Thus, the conventional parts of the bicycle air pump 10 will not be discussed and/or illustrated in detail.

As seen FIGS. 2 and 3, the cylinder portion 12 is a rigid tubular member, which is constructed of a lightweight material. Preferably, the lightweight material of the cylinder portion 12 is formed of a non-magnetically attracted material such as a rigid plastic material or aluminum. The cylinder portion 12 includes a first end 31, a second end 32 and an air compressing chamber 33 disposed between the first and second ends 31 and 32. In this embodiment, the first end 31 of the cylinder portion 12 is fixedly attached to the head portion 18, while an end cap 34 is fixedly attached to the second end 32 of the cylinder portion 12.

The end cap 34 is a rigid member, which is constructed of a lightweight material. Preferably, the lightweight material of the end cap 34 is formed of a non-magnetically attracted material such as a rigid plastic material or aluminum. In this embodiment, the end cap 34 is threaded into the second end 32 of the cylinder portion 12. The end cap 34 has a center hole 38 with the piston rod 14 slidably installed within the center hole 38.

The piston rod 14 is a rigid rod shaped member, which is constructed of a lightweight material. In this embodiment, the piston rod 14 has a first end 41 in which a main body part of the inner piston 16 is integrally formed therewith. A second end 42 of the piston rod 14 is fixedly coupled (embedded) to the handle 20 to move therewith.

The inner piston 16 is movably disposed in the chamber of the cylinder portion 12 for reciprocation. In this embodiment, the inner piston 16 has a rubber sealing member 16*a* that contacts the inner surface of the cylinder portion 12. Thus, the air compressing chamber 33 is formed by the inner surface of the cylinder portion 12, the inner piston 16 and the head portion 18. When the handle 20 is moved back and forth with respect to the head portion 18, the inner piston 16 moves within the cylinder portion 12 to force compressed air out of the head portion 18.

The head portion 18 is a rigid member, which is constructed of a lightweight material. Preferably, the lightweight material of the head portion 18 is formed of a non-magnetically attracted material such as a rigid plastic material or aluminum. The head portion 18 is fixedly coupled to the first end 31 of the cylinder portion 12. The head portion 18 includes an outlet passage 51 and a valve mechanism 52 disposed in the outlet passage 51. The outlet passage 51 communicates with the chamber 33 of the cylinder portion 12 for supplying air to an object (e.g., a bicycle wheel) to be inflated. The valve mechanism 52 is a conventional structure, and thus, the valve mechanism 52 will not be discussed and/or illustrated in detail herein.

The handle 20 is a rigid member, which is constructed of a lightweight material. Preferably, the lightweight material of the handle 20 is formed of a non-magnetically attracted material such as a rigid plastic material. The handle 20 coupled to the second end 42 of the piston rod 14 to move with the piston rod 14.

The magnetic mechanism 22 including a first closure member 61 and a second closure member 62. The first and second closure members 61 and 62 are configured and arranged for magnetically engaging each other to hold the piston rod 14 stationary with respect to the cylinder portion 12 when the piston rod 14 is in a fully retracted position with respect to the cylinder portion 12. In this embodiment, the first closure member 61 is preferably a magnet and the second closure member 62 is preferably formed of a magnetically attracted material such as a steel washer. Alternatively, the first closure member 61 is a magnetically attracted material such as a steel washer and the second closure member 62 is a magnet. Moreover, both the first and second closure members 61 and 62 can be magnets.

In this embodiment, the first closure member 61 is a fastener (bolt) 44 that is used to fixedly attach the inner piston 16 to the piston rod 14, while the second closure member 62 is a ring shaped element or steel washer that is fixedly attached the head portion 18. In other words, in this embodiment, the first closure member 61 is attached to the head portion 18 and the second closure member is attached to the inner piston 16.

Second Embodiment

Figure 4:
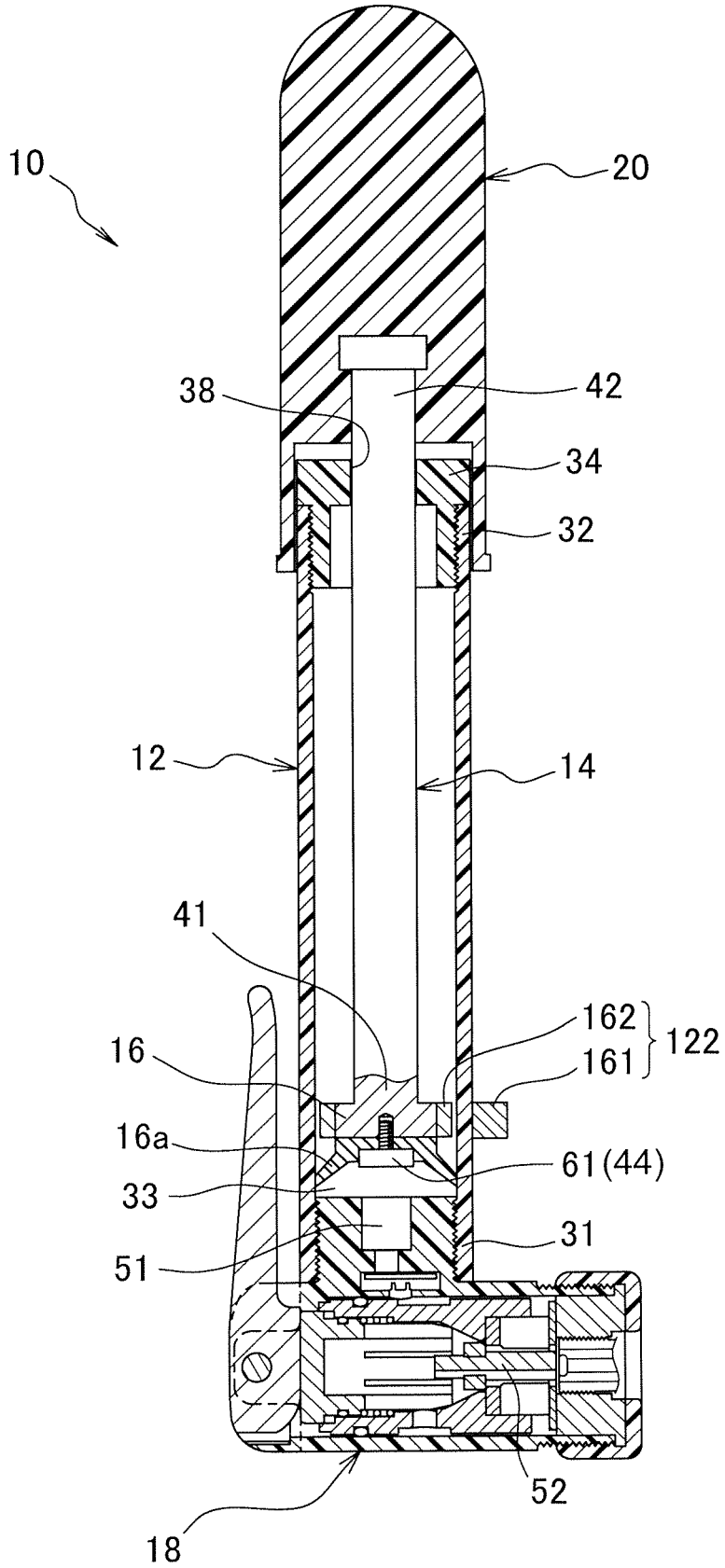
FIG. 4 is a longitudinal cross sectional view of a bicycle air pump in accordance with a second embodiment in which the handle of the bicycle air pump is magnetically held in a retracted position.
Figure 5:
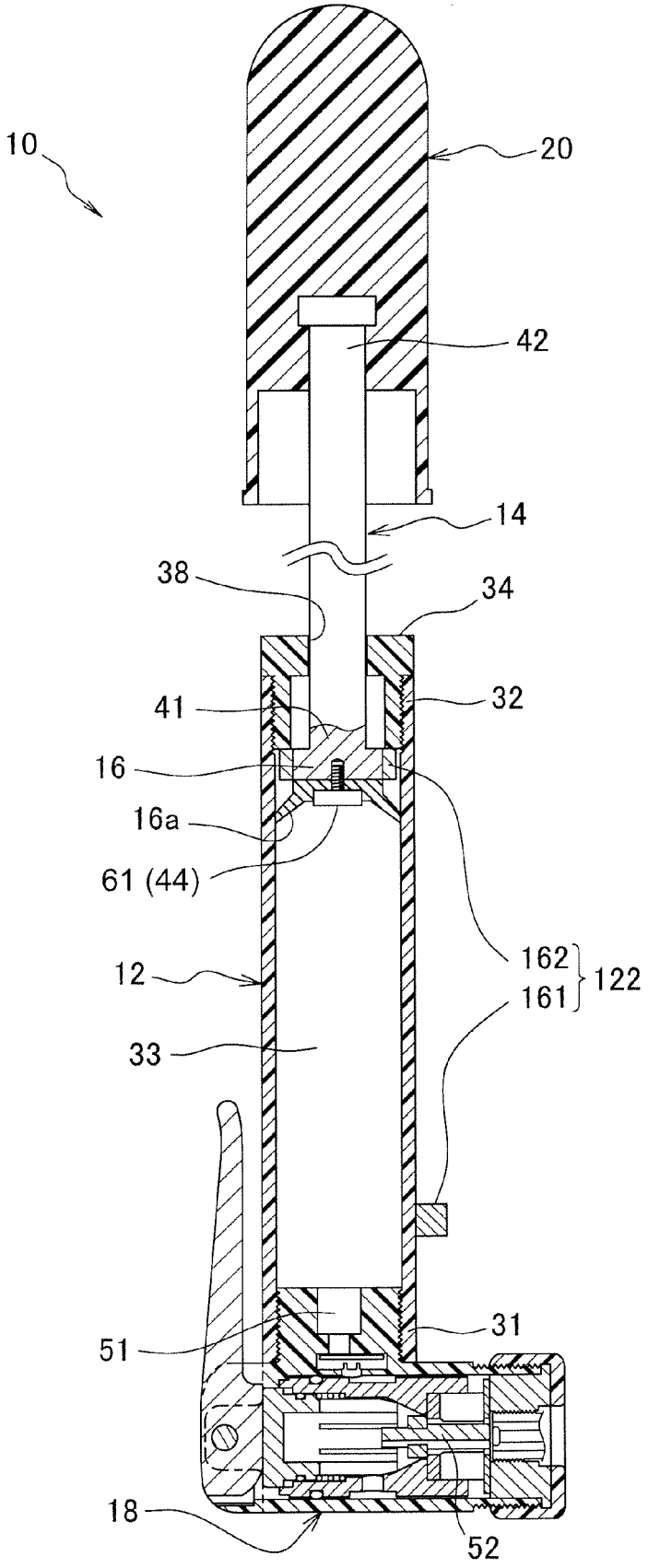
FIG. 5 is a longitudinal cross sectional view of the bicycle air pump illustrated in FIG. 4 in which the handle of the bicycle air pump is in an extended position.

Referring now to FIGS. 4 and 5, a magnetic mechanism 122 is illustrated in accordance with a second embodiment. The magnetic mechanism 122 replaces the magnetic mechanism 22 of the bicycle air pump 10 described above. In other words, the only difference between the first and second embodiments is the magnetic mechanism 122. In view of the similarity between the first and second embodiments, the parts of the second embodiment that are identical to the parts of the first embodiment will be given the same reference numerals as the parts of the first embodiment. Moreover, the descriptions of the parts of the second embodiment that are identical to the parts of the first embodiment may be omitted for the sake of brevity.

As seen in FIGS. 4 and 5, the magnetic mechanism 122 includes a first closure member 161 and a second closure member 162. The first and second closure members 161 and 162 are configured and arranged for magnetically engaging each other to hold the piston rod 14 stationary with respect to the cylinder portion 12 when the piston rod 14 is in a fully retracted position with respect to the cylinder portion 12. In this embodiment, the first closure member 161 is preferably a magnet that is attached to the outer surface of the cylinder portion 12, while the second closure member 162 is preferably a steel washer formed of a magnetically attracted material that is mounted to the end of the piston rod 14. Alternatively, the first closure member 161 is a magnetically attracted material and the second closure member 162 is a magnet. Moreover, both the first and second closure members 161 and 162 can be magnets.

Third Embodiment

Figure 6:
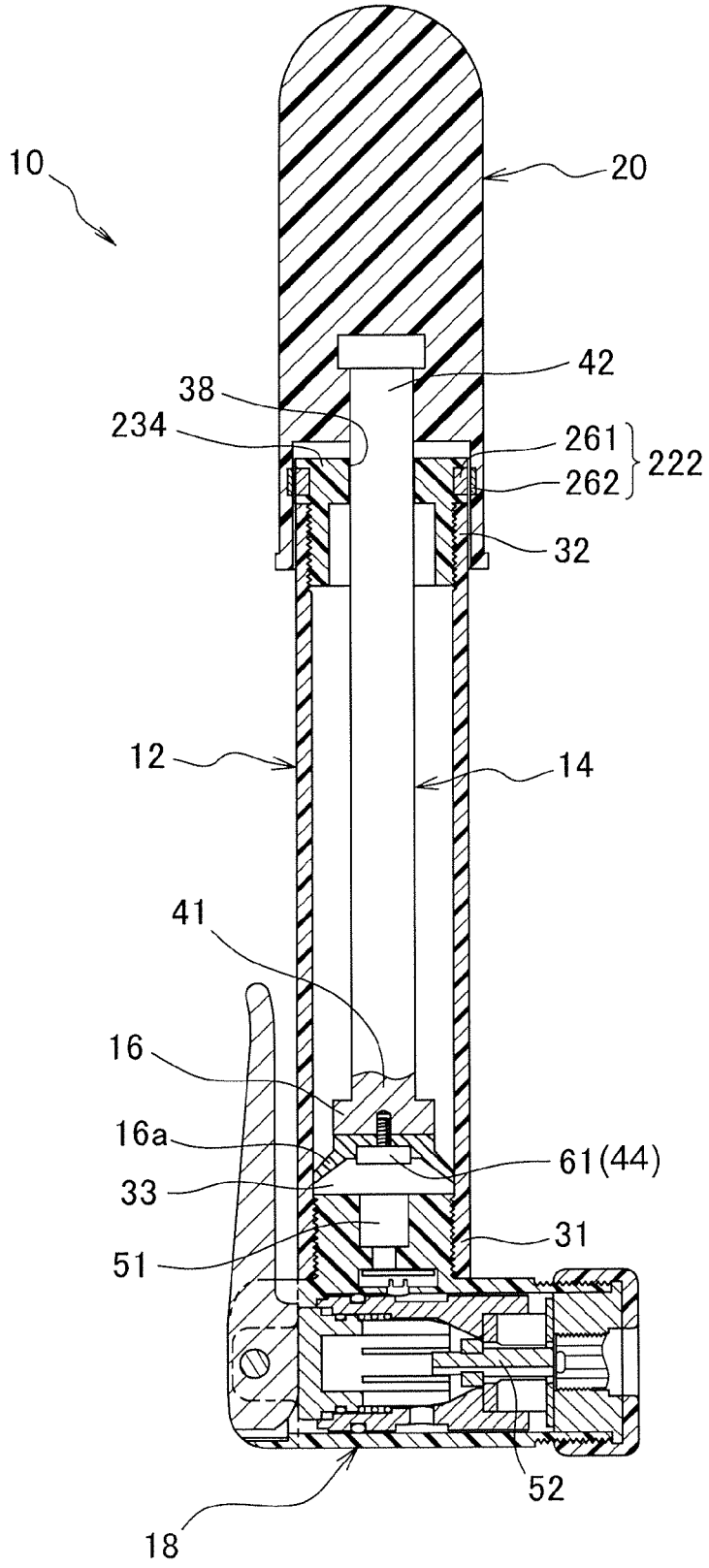
FIG. 6 is a longitudinal cross sectional view of a bicycle air pump in accordance with a third embodiment in which the handle of the bicycle air pump is magnetically held in a retracted position.
Figure 7:
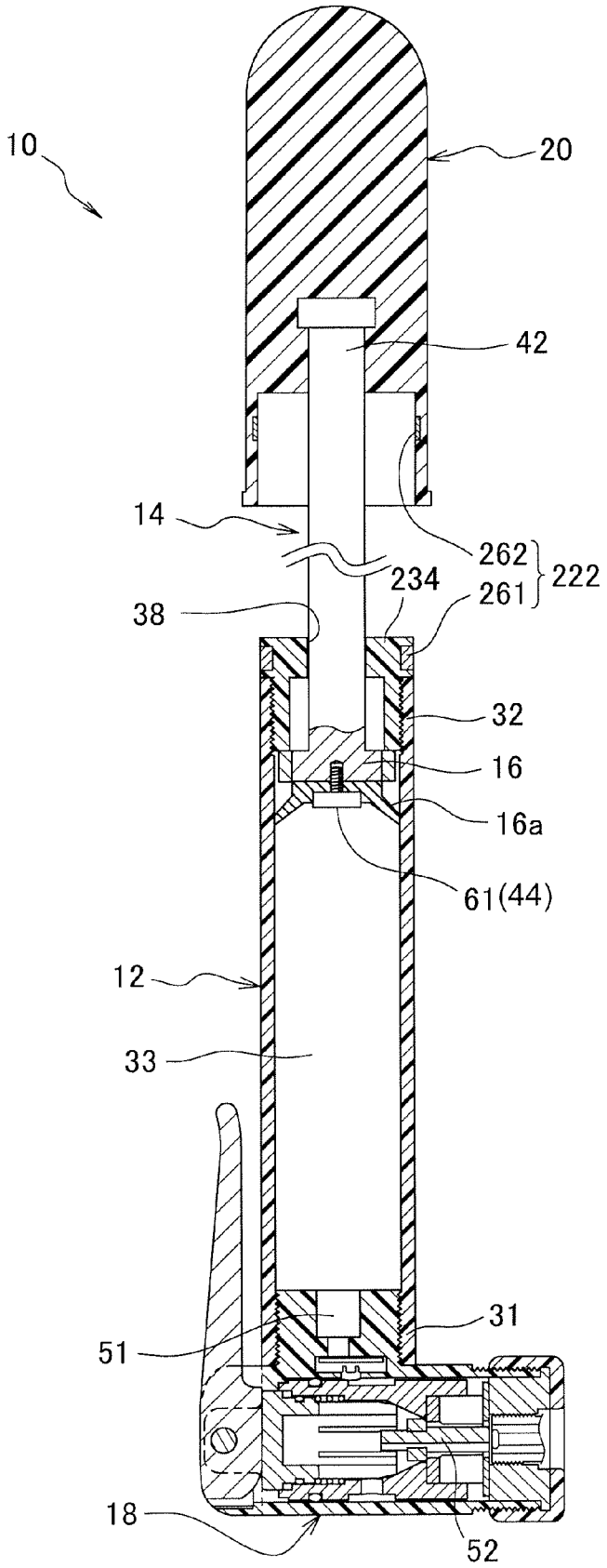
FIG. 7 is a longitudinal cross sectional view of the bicycle air pump illustrated in FIG. 6 in which the handle of the bicycle air pump is in an extended position.

Referring now to FIGS. 6 and 7, a magnetic mechanism 222 is illustrated in accordance with a third embodiment. The magnetic mechanism 222 replaces the magnetic mechanism 22 of the bicycle air pump 10 described above. In other words, the only difference between the first and third embodiments is the magnetic mechanism 222. In view of the similarity between the first and third embodiments, the parts of the third embodiment that are identical to the parts of the first embodiment will be given the same reference numerals as the parts of the first embodiment. Moreover, the descriptions of the parts of the third embodiment that are identical to the parts of the first embodiment may be omitted for the sake of brevity.

As seen in FIGS. 6 and 7, the magnetic mechanism 222 includes a first closure member 261 and a second closure member 262. The first and second closure members 261 and 262 are configured and arranged for magnetically engaging each other to hold the piston rod 14 stationary with respect to the cylinder portion 12 when the piston rod 14 is in a fully retracted position with respect to the cylinder portion 12. In this embodiment, the first closure member 261 is preferably a magnet that is attached to the outer surface of an end cap 234 of the cylinder portion 12, while the second closure member 262 is preferably a steel washer formed of a magnetically attracted material that is mounted to the handle 20. Alternatively, the first closure member 261 is a magnetically attracted material and the second closure member 262 is a magnet. Moreover, both the first and second closure members 261 and 262 can be magnets.

Fourth Embodiment

Figure 8:
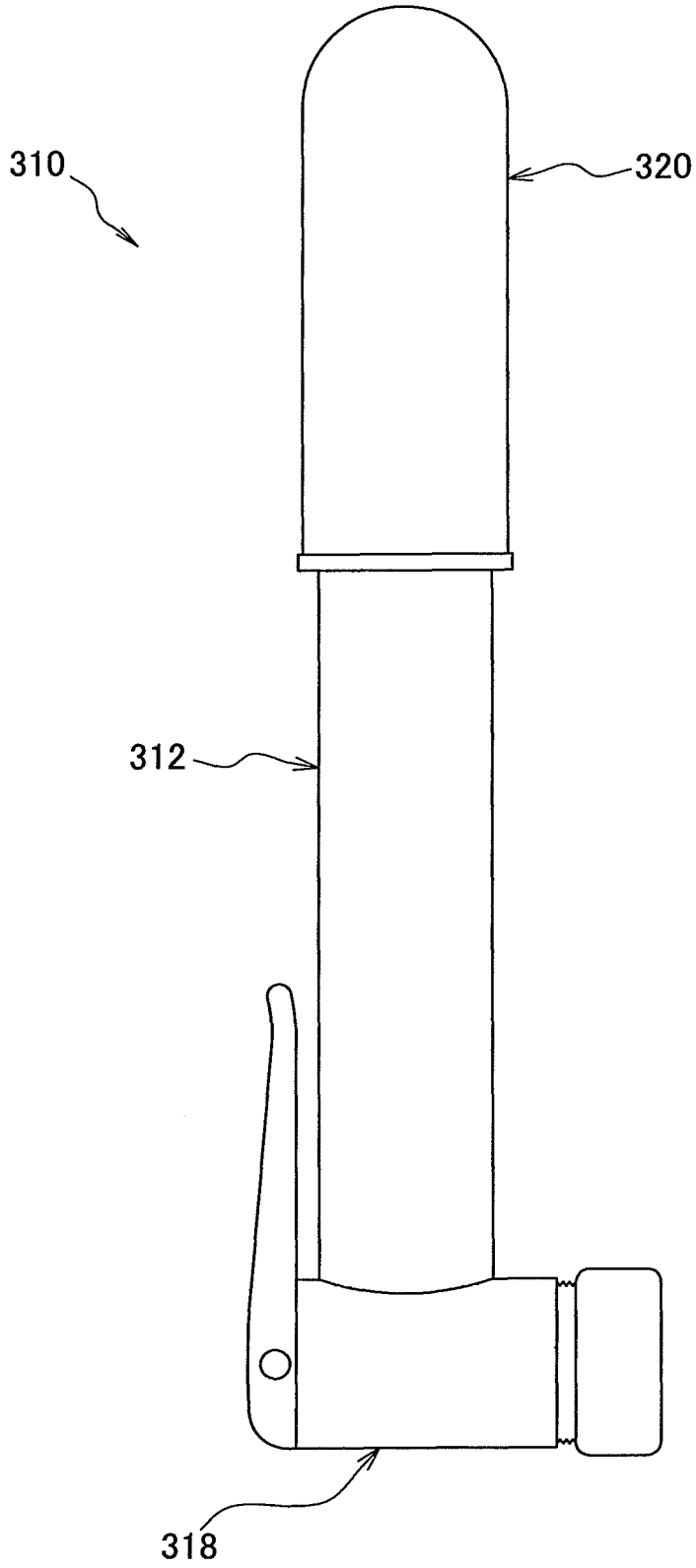
FIG. 8 is a side elevational view of a bicycle air pump in accordance with a fourth embodiment.
Figure 9:
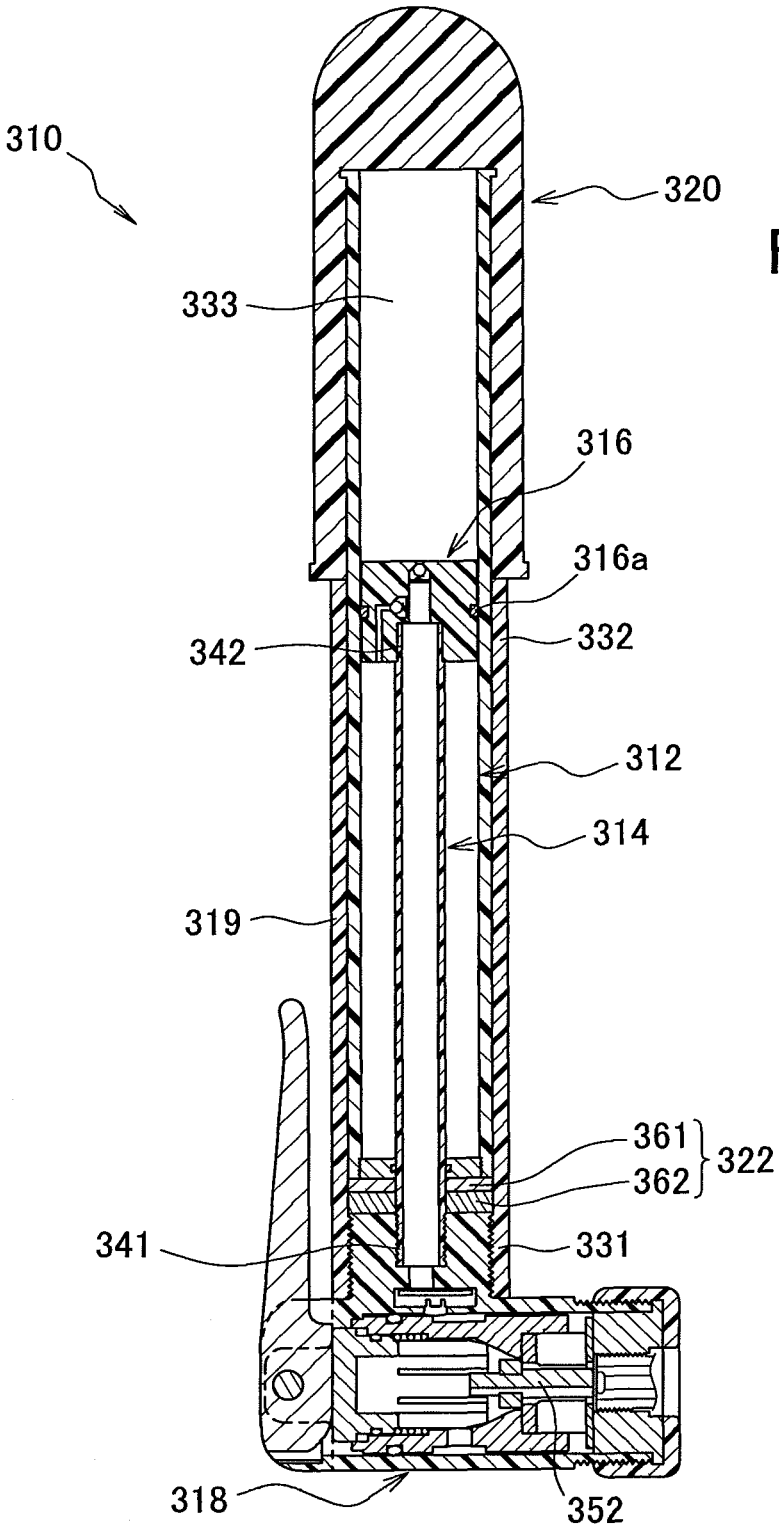
FIG. 9 is a longitudinal cross sectional view of the bicycle air pump illustrated in FIG. 1 in which the handle of the bicycle air pump is magnetically held in a retracted position.
Figure 10:
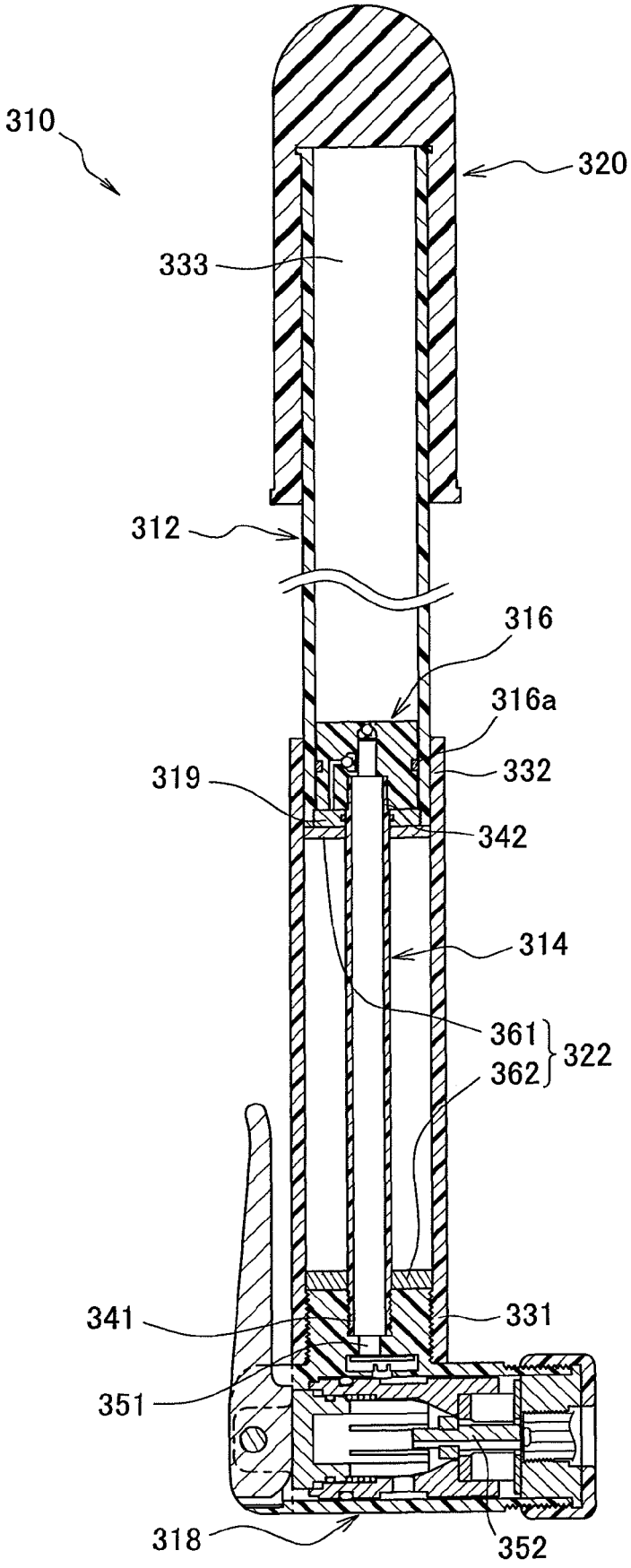
FIG. 10 is a longitudinal cross sectional view of the bicycle air pump illustrated in FIGS. 8 and 9 in which the handle of the bicycle air pump is in an extended position.

Referring now to FIGS. 8 to 10, a bicycle air pump 310 is illustrated in accordance with a fourth embodiment. The bicycle air pump 310 basically includes a cylinder portion 312, a piston rod 314 with an inner piston 316, a head portion 318 with a support tube 319, a handle 320 and a magnetic mechanism 322. Basically, the bicycle air pump 310 is a conventional bicycle air pump, except for the addition of the magnetic mechanism 322 as discussed below. Thus, the conventional parts of the bicycle air pump 310 will not be discussed and/or illustrated in detail.

As seen FIGS. 8 to 10, the cylinder portion 312 is a rigid tubular member, which is constructed of a lightweight material. Preferably, the lightweight material of the cylinder portion 312 is formed of a non-magnetically attracted material such as a rigid plastic material or aluminum. Similarly, the support tube 319 is a rigid tubular member, which is constructed of a lightweight material. Preferably, the lightweight material of the support tube 319 is formed of a non-magnetically attracted material such as a rigid plastic material or aluminum. In this embodiment, the support tube 319 includes a first end 331 fixedly attached to the head portion 318 and a second end 332 slidably supporting the cylinder portion 312. The cylinder portion 312 includes an air compressing chamber 333 that is sealed at one end by the handle 320 and slidably supports the inner piston 316 at the other end. Thus, when the handle 320 is moved from a fully extended position to a fully retracted position, the inner piston 316 reduces the volume of the air compressing chamber 333 of the cylinder portion 312 for forcing compressed air through a passageway in the inner piston 316 and into the piston rod 314. The compressed air is then forced out of the head portion 318.

The piston rod 314 is a rigid hollow tube, which is constructed of a lightweight material. In this embodiment, the piston rod 314 has a first end 341 and a second end 342. The first end 341 is fixedly coupled to the head portion 318 to move therewith. The second end 342 is fixedly coupled to the inner piston 316 to move therewith.

The inner piston 316 is movably disposed in the chamber of the cylinder portion 312 for reciprocation. In this embodiment, the inner piston 316 is a rigid member with a rubber O-ring 316*a* that contacts the inner surface of the cylinder portion 312. Thus, in this embodiment, the air compressing chamber 333 is formed by the inner surface of the cylinder portion 312, the inner piston 316 and the handle 320.

The head portion 318 is a rigid member, which is constructed of a lightweight material. Preferably, the lightweight material of the head portion 318 is formed of a non-magnetically attracted material such as a rigid plastic material or aluminum. The head portion 318 is fixedly coupled to the first end 331 of the support tube 319. The head portion 318 includes an outlet passage 351 and a valve mechanism 352 disposed in the outlet passage 351. The outlet passage 351 communicates with the chamber 333 of the cylinder portion 312 via hollow interior of the piston rod 314 for supplying air to an object (e.g., a bicycle wheel) to be inflated. The valve mechanism 352 is a conventional structure, and thus, the valve mechanism 352 will not be discussed and/or illustrated in detail herein. Thus, when the handle 320 is moved from a fully extended position to a fully retracted position, the inner piston 316 slides within the cylinder portion 312 to reduce the volume of the air compressing chamber 333 of the cylinder portion 312 for forcing compressed air through a passageway in the inner piston 316 and into the piston rod 314. The compressed air is then forced out of the head portion 318 via the outlet passage 351.

The handle 320 is a rigid member, which is constructed of a lightweight material. Preferably, the lightweight material of the handle 320 is formed of a non-magnetically attracted material such as a rigid plastic material. The handle 320 coupled to the second end 332 of the cylinder portion 312 to move with the cylinder portion 312.

The magnetic mechanism 322 including a first closure member 361 and a second closure member 362. The first and second closure members 361 and 362 are configured and arranged for magnetically engaging each other to hold the piston rod 314 stationary with respect to the cylinder portion 312 when the piston rod 314 is in a fully retracted position with respect to the cylinder portion 312. In this embodiment, the first closure member 361 is preferably a magnet that is attached to the cylinder portion 312, while the second closure member 362 is preferably a steel washer formed of a magnetically attracted material that is mounted to the head portion 318. Alternatively, the first closure member 361 is a magnetically attracted material and the second closure member 362 is a magnet. Moreover, both the first and second closure members 361 and 362 can be magnets.

It will be apparent from this disclosure that the first and second closure members 361 and 362 can be configured and arranged in other locations are seen in the prior embodiments for magnetically engaging each other to hold the piston rod 314 stationary with respect to the cylinder portion 312 when the piston rod 314 is in a fully retracted position with respect to the cylinder portion 312.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A bicycle air pump comprising:

a cylinder portion including a first end, a second end and a chamber disposed between the first and second ends;

an inner piston movably disposed in the chamber of the cylinder portion;

a piston rod having a first end and a second end coupled to the inner piston, the piston rod being movable between a retracted position and an extended position with respect to the cylinder portion;

a head portion coupled to the cylinder portion, the head portion including an outlet passage communicated with the chamber of the cylinder portion for supplying air to an object to be inflated;

a handle coupled to the piston rod to move within the chamber; and a magnetic mechanism including first and second closure members for engaging together magnetically to hold the piston rod stationary with respect to the cylinder portion at the retracted position, the first closure member being attached to the inner piston such that the first closure member is exposed toward the head portion in the chamber of the cylinder portion, the second closure member being attached to the head portion such that the second closure member is exposed toward the inner piston in the chamber of the cylinder portion, the first and second closure members being directly in contact in the chamber of the cylinder portion when the piston rod is located at the retracted position, the second closure member including an air passage through which the outlet passage of the head portion fluidly communicates with the chamber of the cylinder portion, and the air in the chamber of the cylinder portion being discharged to the outlet passage of the head portion through the air passage of the second closure member when the piston rod moves from the extended position to the retracted position with respect to the cylinder portion.

2. The bicycle air pump according to claim 1, wherein the first closure member is a magnet and the second closure member is a magnetically attracted material.

3. The bicycle air pump according to claim 2, wherein the magnetically attracted material is a ring shaped element.

4. The bicycle air pump according to claim 2, wherein the second closure member is a ring shaped element which encircles the air passage.

5. The bicycle air pump according to claim 4, wherein the first closure member includes a first axial end face, and the second closure member includes a second axial end face that axially faces the first axial end face of the first closure member in the chamber of the cylinder portion, the first and second axial end faces directly contacting each other in the chamber of the cylinder portion when the piston rod is located at the retracted position.

6. The bicycle air pump according to claim 1, wherein the second closure member is a ring shaped element.

7. The bicycle air pump according to claim 1, wherein the second closure member is a magnet, and the first closure member is a magnetically attracted material.

8. The bicycle air pump according to claim 7, wherein the magnetically attracted material is a ring shaped element.

9. The bicycle air pump according to claim 1, wherein the head portion includes an inner part with the outlet passage, the inner part being disposed inside the first end of the cylinder portion, at least part of the first closure member is disposed on a first axial side of the cylinder portion relative to a distal end of the inner piston in the chamber of the cylinder portion, and at least part of the second closure member is disposed on the first axial side of the cylinder portion relative to a distal end of the inner part of the head portion.

10. The bicycle air pump according to claim 9, wherein the first closure member is a magnet and the second closure member is a magnetically attracted material.

11. The bicycle air pump according to claim 10, wherein the second closure member is a ring shaped element which encircles the air passage.

12. The bicycle air pump according to claim 11, wherein the first closure member includes a first axial end face, and the second closure member includes a second axial end face that axially faces the first axial end face of the first closure member in the chamber of the cylinder portion, the first and second axial end faces directly contacting each other in the chamber of the cylinder portion when the piston rod is located at the retracted position.

* * * * *